US011187471B2

(12) United States Patent
Singh

(10) Patent No.: US 11,187,471 B2
(45) Date of Patent: Nov. 30, 2021

(54) HEAT EXCHANGER FOR SEVERE SERVICE CONDITIONS

(71) Applicant: Holtec International, Camden, NJ (US)

(72) Inventor: Krishna P. Singh, Hobe Sound, FL (US)

(73) Assignee: HOLTEC INTERNATIONAL

( * ) Notice: Subject to any disclaimer, the term of this patent is extended or adjusted under 35 U.S.C. 154(b) by 288 days.

(21) Appl. No.: 16/018,974

(22) Filed: Jun. 26, 2018

(65) Prior Publication Data

US 2019/0003784 A1 Jan. 3, 2019

Related U.S. Application Data

(60) Provisional application No. 62/526,213, filed on Jun. 28, 2017.

(51) Int. Cl.
*F28F 9/02* (2006.01)
*F28D 7/16* (2006.01)

(52) U.S. Cl.
CPC ..... *F28F 9/026* (2013.01); *F28D 7/1607* (2013.01); *F28D 7/1669* (2013.01); *F28F 9/0231* (2013.01); *F28F 9/0278* (2013.01)

(58) Field of Classification Search
CPC ..... F28F 9/026; F28F 9/0231; F28F 9/0278; F28F 9/0263; F28F 9/0265; F28F 9/0282;
(Continued)

(56) References Cited

U.S. PATENT DOCUMENTS 1,841,528 A 2/1930 Gebhardt
1,781,062 A * 11/1930 Huston ..... F24F 5/00 165/58

(Continued)

FOREIGN PATENT DOCUMENTS

CN 201772780 3/2011
CN 103673681 3/2014

(Continued)

OTHER PUBLICATIONS

International Search Report for Corresponding Application No. PCT/US2018/039528 dated Sep. 18, 2018. WO.

(Continued)

*Primary Examiner* — Travis Ruby
*Assistant Examiner* — Raheena R Malik
(74) *Attorney, Agent, or Firm* — The Belles Group, P.C.

(57) ABSTRACT

A heat exchanger for severe temperature and fluid flow conditions in one configuration includes a first longitudinal shell, a second longitudinal shell, and a transverse shell extending transversely between the longitudinal shells. The longitudinal shells may be parallel to each other. The shells are fluidly coupled directly together to form a common shell-side space between an inlet and outlet tubesheet. A generally U-shaped assembly of shells is thus formed. The tube bundle has a complementary U-shaped configuration comprising a plurality of tubes which extend through the longitudinal and transverse shells between the tubesheets. An expansion joint fluidly couples each longitudinal shell to one of the tubesheets. The shell-side inlet and outlet nozzle may be fluidly coupled to the expansion joints for introducing and extracting the shell-side fluid from the heat exchanger. In another configuration, the heat exchanger may be L-shaped with tube bundle of the same configuration.

18 Claims, 9 Drawing Sheets

(58) Field of Classification Search
CPC ..... F28F 2009/0285; F28F 2009/029; F28F 2009/0297; F28F 9/04; F28F 9/06; F28D 7/1607; F28D 7/1669; F28D 7/1615; F28D 7/1623; F28D 7/163; F28D 7/06
USPC ..... 165/144
See application file for complete search history.

(56) References Cited

U.S. PATENT DOCUMENTS 1,788,673 A * 1/1931 Houston ..... F25B 9/004 62/238.2
1,814,010 A 7/1931 Snow
2,424,221 A * 7/1947 Brown, Jr. ..... F28D 7/06 285/123.1
2,452,391 A 10/1948 O'Sullivan et al.
2,520,755 A * 8/1950 Brown, Jr. ..... F28F 9/0219 165/158
2,549,093 A * 4/1951 Huber ..... F28F 9/26 126/109
2,612,350 A * 9/1952 Stadler ..... F28D 7/06 165/82
3,018,090 A * 1/1962 Kaase ..... F28D 7/06 165/143
3,048,372 A * 8/1962 Newton, Jr. ..... F28F 9/22 165/158
3,079,992 A * 3/1963 Otten ..... F28D 7/06 165/76
3,144,081 A * 8/1964 Skiba ..... F28D 7/06 165/162
3,155,404 A * 11/1964 Brown, Jr. ..... F16L 39/00 285/123.2
3,177,934 A * 4/1965 Hoppe, Jr. ..... F28D 7/1607 165/143
3,249,153 A * 5/1966 Holland ..... F28F 9/26 165/76
3,377,087 A * 4/1968 Samerdyke ..... F16L 39/00 285/14
3,424,480 A * 1/1969 Holland ..... F16L 7/02 285/111
3,593,782 A * 7/1971 Draves ..... F28F 9/0219 165/143
3,692,140 A * 9/1972 Smith ..... B64F 1/26 181/213
3,948,315 A * 4/1976 Powell ..... F28D 7/06 165/70
4,114,684 A * 9/1978 Jenis ..... F28F 9/0131 165/82
4,120,350 A 10/1978 Norton
4,136,734 A * 1/1979 Sasaki ..... F22D 1/32 122/32
4,156,457 A * 5/1979 Murray ..... B01D 53/14 165/143
4,429,662 A * 2/1984 Hashizume ..... F22B 1/02 122/32
4,506,728 A 3/1985 Gentry
4,561,496 A 12/1985 Kehrer
5,309,946 A * 5/1994 Ligneul ..... F15D 1/02 138/39
5,419,391 A 5/1995 Chan et al.
8,091,617 B2 * 1/2012 Kirschenmann ..... F28F 9/0246 165/144
8,794,299 B2 * 8/2014 Barfknecht ..... F28D 7/1692 165/41
9,786,394 B2 10/2017 Singh et al.
2003/0089491 A1 * 5/2003 Mitsumoto ..... F28D 7/1615 165/157
2010/0282451 A1 11/2010 Singh et al.
2014/0311466 A1 10/2014 Schuricht et al.
2016/0003551 A1 1/2016 Fujita et al.
2016/0169229 A1 * 6/2016 Kimura ..... F28D 7/16 417/243
2016/0260508 A1 * 9/2016 Singh ..... G21D 1/04
2017/0016678 A1 1/2017 Singh et al.
2017/0336147 A1 * 11/2017 Dieguez Fortes .... F28D 7/1684

FOREIGN PATENT DOCUMENTS

CN 103954153 7/2014
CN 104110329 10/2014
CN 106017150 10/2016
CN 205919715 2/2017
CN 106802098 6/2017
JP S57-004684 1/1982
JP 2006514909 5/2006
JP 2009058144 3/2009
KR 100729705 B1 6/2007
WO WO-2015061641 A1 * 4/2015 ..... G21C 15/22

OTHER PUBLICATIONS

European Patent Office, European Supplementary Search Report issued in counterpart European Application No. EP18825021, dated Feb. 23, 2021, pp. 1-8.

* cited by examiner

HEAT EXCHANGER FOR SEVERE SERVICE CONDITIONS

CROSS-REFERENCE TO RELATED APPLICATIONS

The present application claims the benefit of priority to U.S. Provisional Application No. 62/526,213 filed Jun. 28, 2017; the entirety of which is incorporated herein by reference.

BACKGROUND OF THE INVENTION

The present invention generally relates to heat exchangers, and more particularly to a shell and tube type heat exchangers suitable for the power generation industry.

Shell and tube type heat exchangers are used in the power generation and other industries to heat or cool various process fluids. For example, heat exchangers such as feedwater heaters are employed in Rankine power generation cycles in combination with steam turbine-generator sets to produce electric power. In such applications, the shell-side fluid (i.e. fluid flowing within the shell external to the tubes) is typically steam and the tube-side fluid (i.e. fluid flowing inside the tubes) is feedwater. Lower pressure steam exhausted from the turbine is condensed which forms the feedwater. Multiple feedwater heaters are generally employed in a Rankine cycle to sequentially and gradually increase the temperature feedwater using steam extracted from various extraction points in the steam turbine. The heated feedwater is returned to the steam generator where it is converted back to steam to complete the cycle. The heat source used to convert the feedwater to steam in the steam generator may be nuclear or fossil fuels.

In certain operating conditions, high longitudinal stresses in the shell and the tube bundle arise from differential thermal expansion due to differences in the shell and tubing material's coefficients of thermal expansion and fluid temperatures between the two flow streams (tube-side and shell-side). In fixed tubesheet heat exchangers operating under severe service conditions at high temperatures (e.g. temperatures in excess of 500 degrees F.), the differential expansion induced stress is the greatest threat to the unit's integrity and reliability. Other design alternatives used in the industry, such as a straight shell with an in-line bellow type expansion joint, outside packed floating head, etc., suffer from demerits such as risk of leakage (packed head design) or reduced structural ruggedness (expansion joint design).

A need exists for an improved heat exchanger design which can compensate more effectively for differential thermal expansion.

SUMMARY OF THE INVENTION

Shell and tube heat exchangers suitable for feedwater heating and other process fluid heating applications according to the present disclosure can compensate for differential thermal in a manner which overcomes the problems with past fixed tubesheet designs. In one configuration, the heat exchanger includes a plurality of shells which may joined and fluidly coupled together in a variety of polygonal or curvilinear geometric shapes to form an integrated singular shell-side pressure retention boundary, and a tube bundle having a complementary configuration to the shell assembly. The shells may be welded together in one construction. The shell-side spaces within each shell of the assembly are in fluid communication forming a contiguous shell-side space through which the tubes of the tube bundle are routed. It bears noting the present assembly of shells collectively form a the single heat exchanger since each shell is not in itself a discrete or separate heat exchanger with its own dedicated tube bundle. The heat exchanger thus comprises a single tube-side inlet tubesheet and single tube-side outlet tubesheet located within different shells, as further described herein.

In one design variation, the heat exchanger may include two or more rectilinear shells arranged to form a continuous curved U-shape with a tube bundle that parallels the curvilinear axial profile of the shell assembly. The heat exchanger may be in the general shape of the Greek letter Π ("PI") in one embodiment comprising two parallel longitudinal shells and a transverse shell fluidly coupled between the longitudinal shells. Two tubesheets, one at the same ends of each longitudinal shell, define the extent of the shell-side space and volume within the heat exchanger. Each end of the transverse shell may be capped to create a fully sequestered shell-side space. The shell-side spaces in the longitudinal and transverse shells are in fluid communication, thereby producing a shell-side fluid path that conforms to the shape of the shell. The tube legs, formed in the shape of broad or squared "U", are fastened at their extremities to a respective one of the tubesheets in a manner that creates leak tight joints. Advantageously, the curved tubes serve to substantially eliminate the high longitudinal stresses in the shell and the tube bundle that arise from differential thermal expansion from the differences in the shell and tubing material's coefficients of thermal expansion and fluid temperatures between the two flow streams (shell-side and tube-side).

In another design variation, the heat exchanger shell may be L-shaped with the tube bundle having a complementary configuration and a pair of tubesheets. This embodiment comprises a longitudinal shell and a transverse shell fluidly coupled thereto and oriented perpendicularly to the longitudinal shell.

The common features of the curvilinear shell heat exchanger embodiments discloses herein are: (1) there is a single tube pass and a single shell pass; (2) the arrangement of tube-side and shell-side fluid streams may be completely countercurrent to produce maximum heat transfer; (3) each tubesheet is joined to a tube-side header or nozzle; and (4) the multiple shells of heat exchanger will each in general be smaller in diameter shells than its conventional single shell U-tube counterpart, thereby advantageously resulting in less differential thermal expansion between each smaller diameter shell and tube bundle.

In some embodiments, the shell-side fluid may be steam and the tube-side fluid may be liquid such as water. In other embodiments, the shell-side fluid may also be liquid. Liquids other than water such as various chemicals may be used in some applications of the present heat exchanger.

In one aspect, a heat exchanger includes: a longitudinally-extending first shell defining a first shell-side space and a first longitudinal axis; a longitudinally-extending second shell defining a second shell-side space and a second longitudinal axis, the second shell arranged parallel to the first shell; a transverse third shell fluidly coupling the first and second shells together, the third shell extending laterally between the first and second shells and defining a third shell-side space in fluid communication with the first and second shell-side spaces; a tube bundle comprising a plurality of tubes each defining a tube-side space, the tube bundle extending through the first, second, and third shells; a shell-side inlet nozzle fluidly coupled to the first shell; and a shell-side outlet nozzle fluidly coupled to the second shell;

wherein a shell-side fluid flows in path from the first shell-side space through the third shell-side space to the second shell-side space.

In another aspect, a heat exchanger includes: a longitudinally-extending first shell defining a first shell-side space and a first longitudinal axis; a longitudinally-extending second shell defining a second shell-side space and a second longitudinal axis, the second shell arranged parallel to the first shell; a third shell fluidly coupled to a first terminal end of the first shell and a first terminal end of the second shell, the third shell extending laterally between the first and second shells, the third shell defining a transverse axis and a third shell-side space in fluid communication with the first and second shell-side spaces; a U-shaped tube bundle comprising a plurality of tubes each defining a tube-side space, the tube bundle extending through the first, second, and third shells; an inlet tubesheet and an outlet second tubesheet; a tube-side inlet nozzle fluidly coupled to the inlet tubesheet; a tube-side outlet nozzle fluidly coupled to the outlet tubesheet; a first expansion joint coupled between the inlet tubesheet and a second terminal end of first shell; a second expansion joint coupled between the outlet tubesheet and a second terminal end of second shell; a shell-side inlet nozzle fluidly coupled to the second expansion joint, wherein the shell-side fluid is introduced into the first shell through the second expansion joint; a shell-side outlet nozzle fluidly coupled to the first expansion joint, wherein the shell-side fluid is extracted from the second shell through the first expansion joint; wherein a shell-side fluid flows in path from the first shell-side space through the third shell-side space to the second shell-side space.

In another aspect, a heat exchanger includes: a longitudinally-extending first shell defining a first shell-side space and a first longitudinal axis, the first shell including first and second terminal ends; a transversely extending second shell defining a second shell-side space and a second transverse axis, the second shell including first and second terminal ends, the second shell fluidly coupled to the first terminal end of the first shell and oriented perpendicularly to the first shell; an L-shaped tube bundle comprising a plurality of tubes each defining a tube-side space, the tube bundle extending through the first and second shells; a first tubesheet and a second tubesheet; a first expansion joint coupled between the first tubesheet and the second terminal end of first shell; a second expansion joint coupled between the second tubesheet and the second terminal end of second shell; a shell-side inlet nozzle fluidly coupled to the second expansion joint, wherein the shell-side fluid is introduced into the second shell through the second expansion joint; a shell-side outlet nozzle fluidly coupled to the first expansion joint, wherein the shell-side fluid is extracted from the first shell through the first expansion joint; wherein a shell-side fluid flows in path from the second shell-side space into the first shell-side side space.

Any of the features or aspects of the invention disclosed herein may be used in various combinations with any of the other features or aspects. Accordingly, the invention is not limited to the combination of features or aspects disclosed herein as examples.

Further areas of applicability of the present invention will become apparent from the detailed description hereafter and drawings.

BRIEF DESCRIPTION OF THE DRAWINGS

The features of the exemplary embodiments will be described with reference to the following drawings where like elements are labeled similarly, and in which.

Figure 1:
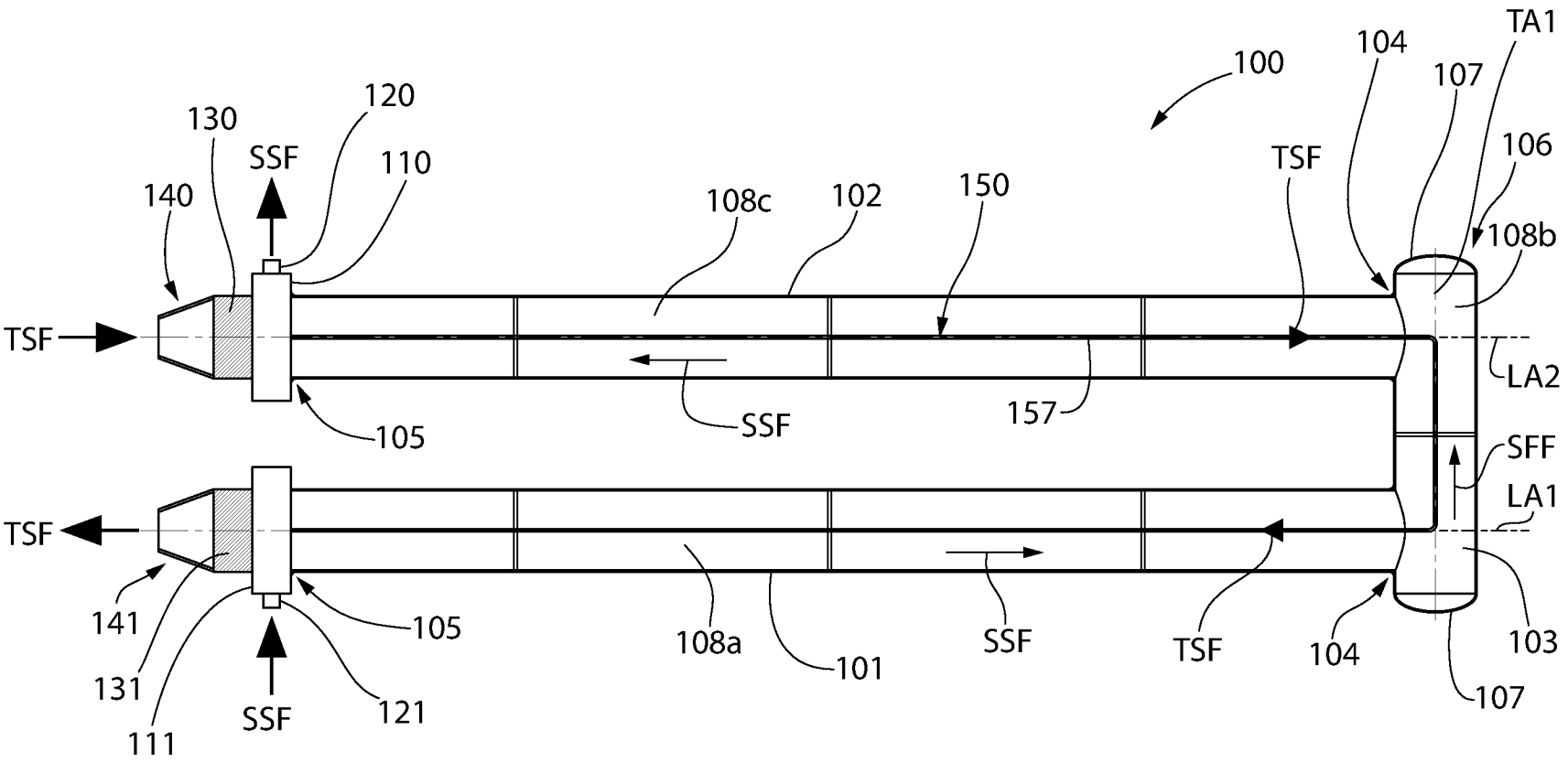
FIG. 1 is a plan view of a heat exchanger according to the present disclosure.

All drawings are schematic and not necessarily to scale. Parts shown and/or given a reference numerical designation in one figure may be considered to be the same parts where they appear in other figures without a numerical designation for brevity unless specifically labeled with a different part number and described herein.

DETAILED DESCRIPTION OF THE INVENTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

FIGS. 1-9 depict a first embodiment of a shell and tube heat exchanger 100 according to the present disclosure. Heat exchanger 100 includes a first longitudinal shell 101 defining a longitudinal axis LA1, second longitudinal shell 102 defining a longitudinal axis LA2, and a transverse shell 103 defining a transverse axis TA1. Longitudinal shells 101 and 102 are cylindrical and define internal open shell-side spaces 108*a*, 108*c* respectively of the same configuration for receiving and circulating a shell-side fluid SSF. Transverse shell 103 is cylindrical and defines an internal open shell-side space 108*b* of the same configuration. The shell-side spaces 108*a*-108*c* are in fluid communication such that each shell-side space fully opens into adjoining shell-side spaces to form a single curvilinear and contiguous common shell-side space for holding a tube bundle.

Each shell 101-103 is linearly elongated and straight having a greater length than diameter. Longitudinal shells 101, 102 may be longer than transverse shell 103, which in some embodiments has a length greater than the diameters of the longitudinal shells combined. In some embodiments, longitudinal shells 101 and 102 each have a length greater than twice the length of the transverse shell 103. In the illustrated embodiment, the longitudinal shells 101, 102 have substantially the same length. In other embodiments, it is possible that one longitudinal shell has a shorter length than the other longitudinal shell.

In the present configuration, the shells 101-103 are collectively arranged in the general shape of a "U" form, or more specifically in the illustrated embodiment in a "PI" shape (as in the Greek letter Π). Each of the longitudinal shells 101, 102 has a first terminal end 104 fluidly joined or coupled directly to the transverse shell 103 without any intermediary piping or structures, and an opposite second terminal end 105 attached and fluidly coupled to a respective tubesheet 111 and 110, as best shown in FIG. 1. Shells 101 and 102 may be welded to transverse shell 103 in one embodiment to form a sealed leak-proof fluid connection and pressure retention boundary. Longitudinal shells 101 and 102 are laterally spaced apart and arranged parallel to each other. Transverse shell 103 extends laterally and transversely between the longitudinal shells at shell ends 104. In one embodiment, transverse shell 103 is oriented perpendicularly to shells 101 and 102. The transverse shell 103 includes a pair of opposing cantilevered end portions 103*a* each extending laterally outwards beyond the first and second shells which define opposing ends 106. An end cap 107 is attached to each cantilevered end by a suitable leak proof joining method such as welding. End caps 107 may be any ASME Boiler & Pressure Vessel Code (B&PVC) compliant heads including commonly used head types such as hemispherical ("hemi heads"), semi-elliptical (see, e.g. FIG. 6), flanged and dished, and flat. The shells and other portions of the heat exchanger 100 are also constructed to produce an ASME B&PVC compliant construction.

The heat exchanger 100 is essentially a planar structure or assembly in which the shells 101, 102, and 103 lie in substantially the same plane. Heat exchanger 100 can advantageously be mounted in any orientation in an available three-dimensional space in the facility to best accord with the plant's architectural and mechanical needs (piping runs, support foundation locations, vent & drain lines, etc.). Accordingly, the heat exchanger shown in FIG. 1 may be mounted vertically, horizontally, or at any angle therebetween. Although the shell-side inlet and outlet nozzles 121, 120 are illustrated as coplanar with the shells 101 and 102 in FIG. 1, in other embodiments the shell nozzles can be rotated and positioned at any angle, as desired, to accommodate piping runs to and from the heat exchanger without loss in performance efficacy and efficiency. In other possible embodiments, one of the longitudinal shells 101 or 102 may be oriented non-planar with the other longitudinal shell by rotating the position of one of the longitudinal shells on the transverse shell 103. For example, the longitudinal shell 101 may be in the horizontal position shown in FIG. 1 while the remaining longitudinal shell 102 may instead be in a vertical position disposed perpendicularly to shell 101, or at any angle between 0 and 90 degrees to shell 101. The tubes would therefore be formed to have a complementary configuration to the layout and orientation of the shells 101-103 selected.

Figure 2:
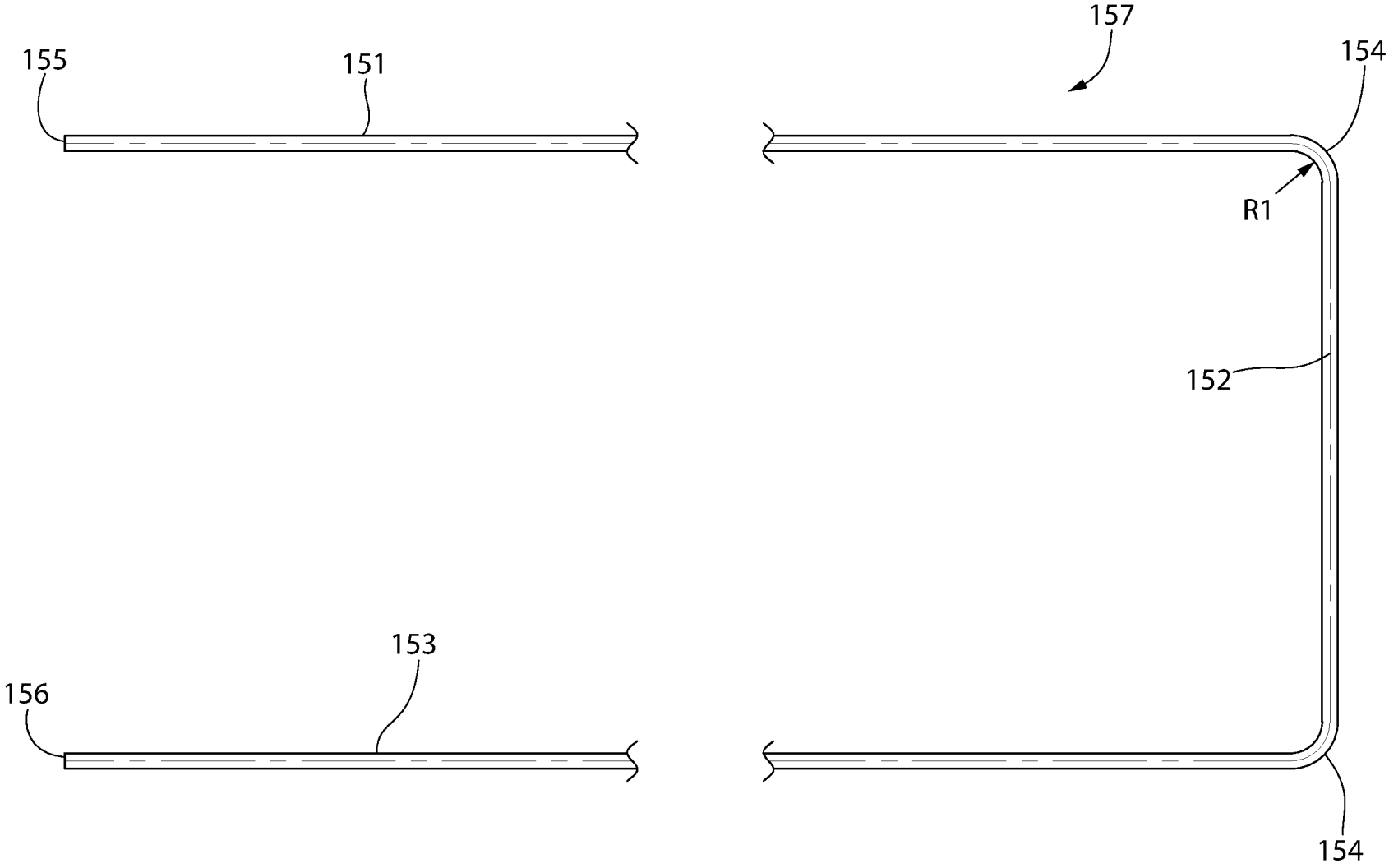
FIG. 2 is a plan view of a tube of the heat exchanger of FIG. 1.

With continuing general reference to FIGS. 1-9, a generally "squared" U-shaped tube bundle 150 is disposed in the longitudinal and transverse shells 101-103. The tube bundle 150 comprises a plurality of squared U-shaped tubes 157 which extend contiguously from tube-side inlet tubesheet 130 of longitudinal shell 102 through the shell-side spaces 108*a*, 108*b*, and 108*c* to tube-side outlet tubesheet 131 of longitudinal shell 101. FIG. 2 depicts a single tube 157, recognizing that the tube bundle 150 comprises multiple tubes of similar shape arranged in parallel to each other to form a tightly packed tube bundle. Tubes 157 are cylindrical with a circular or round cross section. Tubes 157 each include a pair of laterally spaced apart and parallel straight tube legs 151 and 153, and a transversely and perpendicularly extending straight crossover tube leg 152 fluidly coupled between legs 150, 151 by 90-degree arcuately curved and radiused tube bends 154. Tube bends 154 preferably have a radius R1 equal to or greater than 2.5 times the tube diameter. Crossover tube leg 152 may have a length less than the two straight tube legs 151, 153. It bears noting that tube legs 151-153 form a continuous and contiguous tube structure and tube-side space. It bears noting that the present construction differs from conventional U-tube bundles which have large radiused 180 degree curved tube bends to connect each straight tube leg. The convention construction therefore lacks the third straight section and 90 degree tube bends 154.

Figure 3:
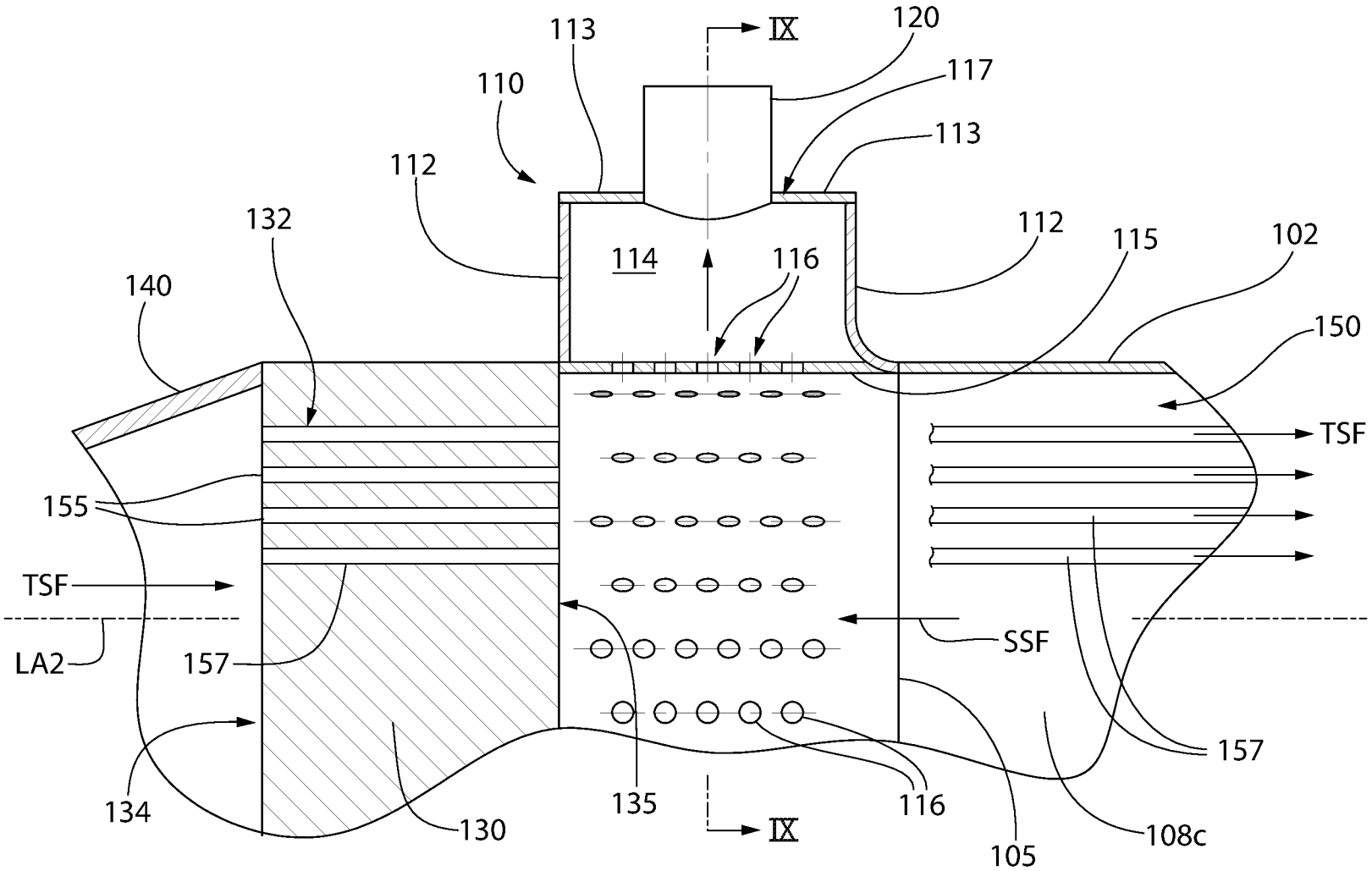
FIG. 3 is a partial side cross-sectional view of an expansion joint and shell-side inlet nozzle configuration of the heat exchanger of FIG. 1.

Tubes 157 each include a first end 155 defined by leg 151 which extends through tubesheet 130 and a second end 156 defined by leg 153 which extends through tubesheet 131 (see, e.g. FIG. 3). Tubesheets 130, 131 each include a plurality of axially extending and parallel through bores 132 oriented parallel to longitudinal axes LA1 and LA2 of shells 101 and 102 respectively. Terminal end portions of tubes 157 are received in and extend completely through and inside through bores 132 to the outboard surface or face 134 of tubesheets 130, 131 (an example of the face 134 of tubesheet 130 being shown in FIG. 3). The open ends 155 of tubes 157 in tubesheet 130 receive the tube-side fluid TSF. Conversely, the other open ends 156 of tubes 157 in tubesheet 131 discharge the tube-side fluid. The tubesheets 130, 131 support the terminal end portions of the tubes in a rigid manner.

The tubes 157 are fixedly coupled to tubesheets 130, 131 in a sealed leak-proof manner to prevent leakage from the higher pressure tube-side fluid TSF to the lower pressure shell-side fluid SSF. The pressure differential between shell side and tube side may be extremely great for some high pressure heaters creating higher exposure for tube-to-tubesheet joint leaks. For example, tube-side design pressures can range from about 300 psig to over 5000 psig for high pressure feedwater heaters, while the shell-side design pressures can range from about 50 psig to 1500 psig for higher pressure heaters. In some embodiments, the tubes 157 may rigidly coupled to the tubesheets 130, 131 via expansion or expansion and welding; these techniques being well known in the art without further elaboration required. Tube expansion processes that may be used include explosive, roller, and hydraulic expansion.

The tubes 157 may be formed of a suitable high-strength metal selected for considerations such as for example the service temperature and pressure, tube-side and shell-side fluids, heat transfer requirements, heat exchanger size considerations, etc. In some non-limiting examples, the tubes may be formed of stainless steel, Inconel, nickel alloy, or other metals typically used for power generation heat exchangers which generally excludes copper which lacks the mechanical strength for such applications.

The tubesheets 130, 131 have a circular disk-like structure and an axial thickness suitable to withstand cyclical thermal stresses and provide proper support for the tubes 157. The tubesheets may each have a thickness substantially greater than the thickness of their respective shells 101, 102 (e.g. 5 times or greater) as illustrated in FIG. 3. Tubesheets 130, 131 include a vertical outboard surface or face 134 and inboard surface or face 135. The tubesheets 130, 131 may be formed of a suitable metal, such as steel including alloys thereof. The tubesheets may be formed of stainless steel in one embodiment.

The outer rim of tubesheets 130, 131 is preferably made as thin (radially) as possible within the limitations of the machining equipment so that the differential thermal expansion in the radial direction due to the temperature difference between the perforated region of the tubesheets containing through bores 132 and the solid outer peripheral rim does not produce high interface stresses. The outer peripheral rim may be machined, as practicable, to reduce the rim thickness. Typically, the rim can be made as little as ¼-inch thick in some instances (measured from the outermost tube bore).

Figure 4:
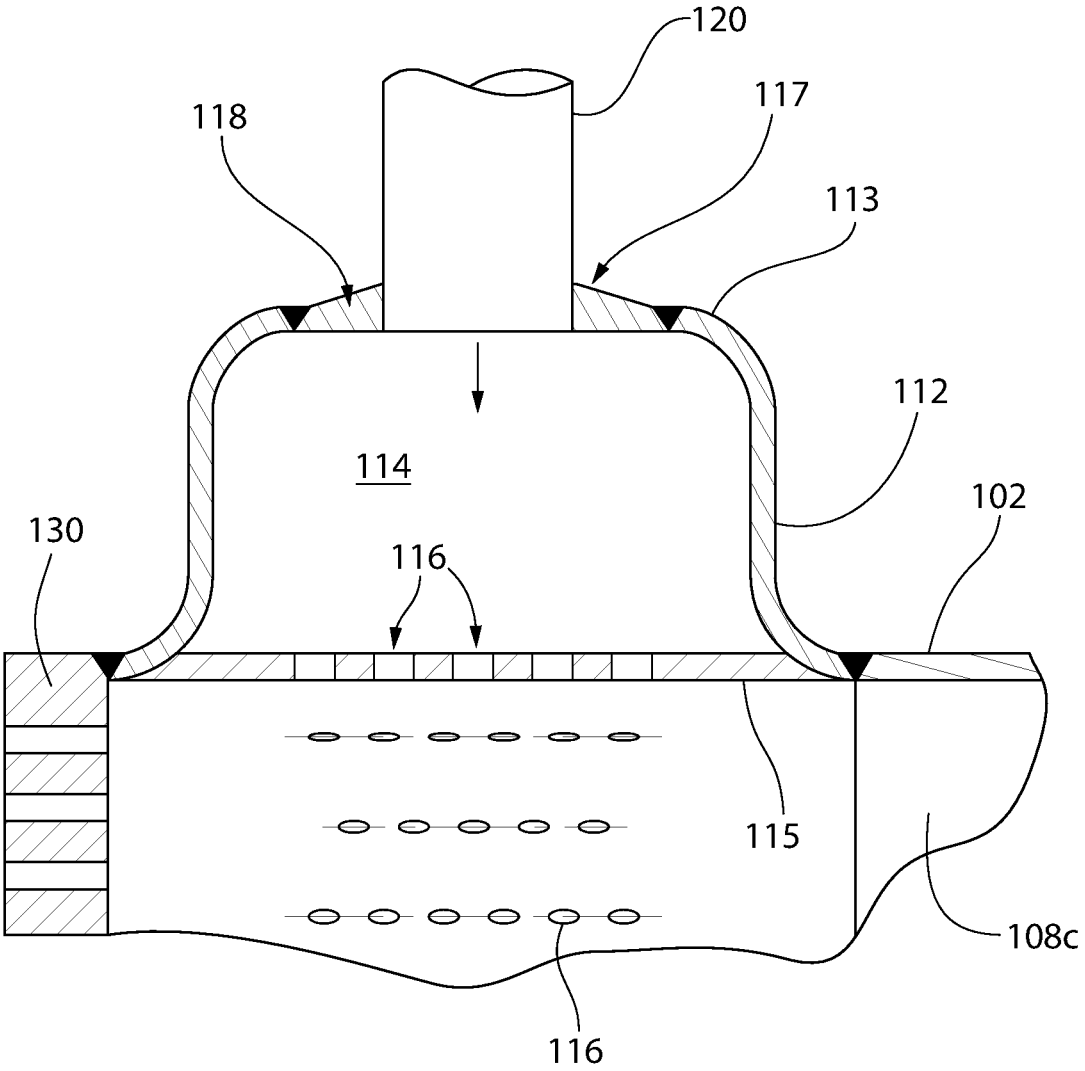
FIG. 4 is a partial side cross-sectional view of an alternative expansion joint and shell-side inlet nozzle configuration.
Figure 5:
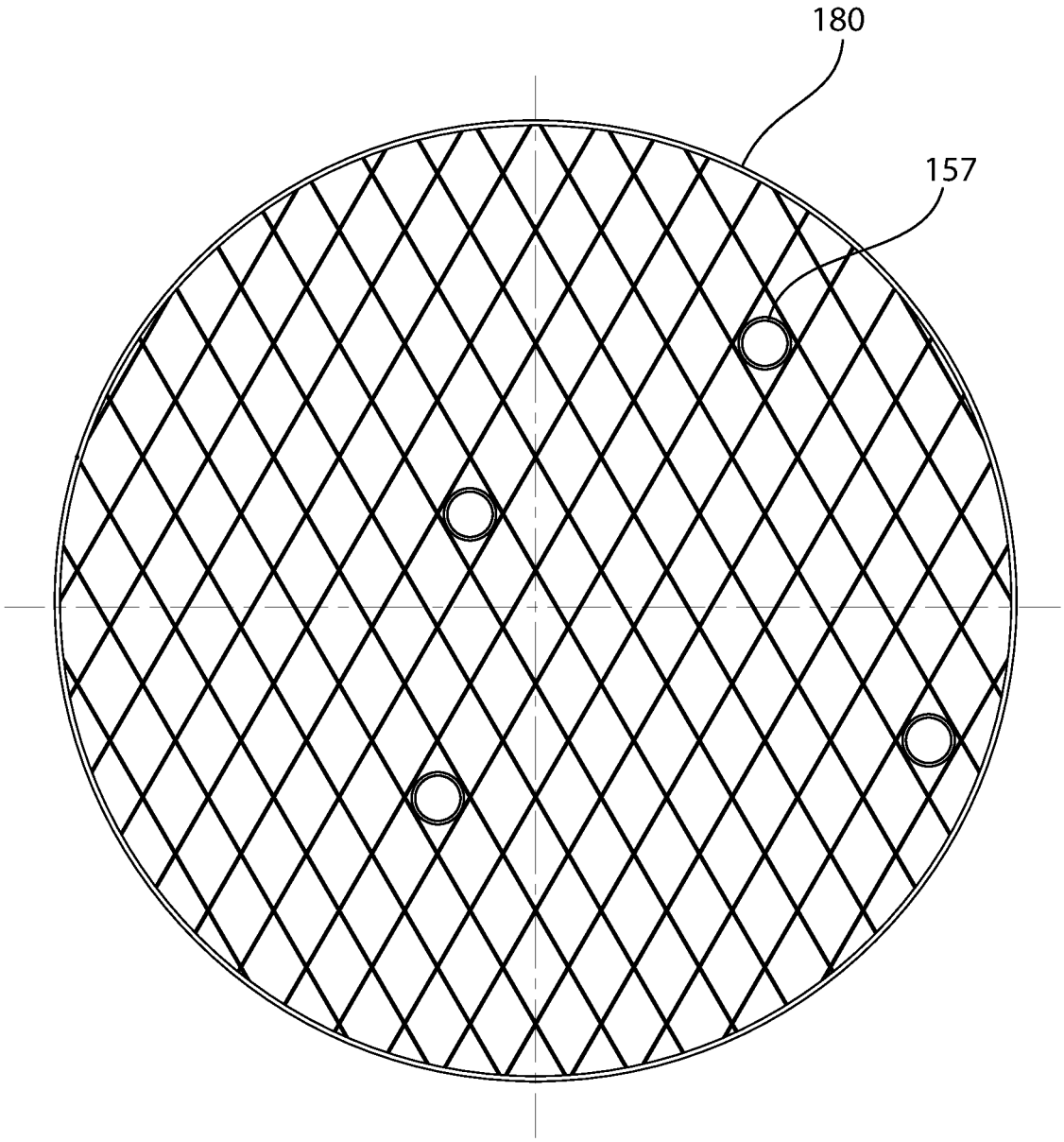
FIG. 5 is a side view of a baffle of the heat exchanger of FIG. 1.

According to one aspect of the present invention, each longitudinal shell 101, 102 is preferably joined to its tubesheet 130, 131 in a flexible manner by an intervening "flexible shell element assembly" such as expansion joints 110 and 111 (see, e.g. FIGS. 1, 3, and 4). Expansion joints 110, 111 may flanged and flued expansion joints which provide a structurally robust construction and reliable leak-proof service in contrast to bellows type expansion joints used for heat exchanger shells which are generally more susceptible to failure and leakage. The expansion joints 110, 111 mitigate stress levels from the differential thermal expansion (radial) between the shell and the tubesheet at their interface unlike directly welding the shell to the tubesheet in a rigid fixed tubesheet arrangement with no flexibility to accommodate differential thermal expansion.

Referring particularly to FIGS. 3 and 4, a flanged and flued expansion joint 110, 111 is formed in two halves (e.g. first and second half sections) each including a radially extending flanged portion 112 arranged perpendicularly to longitudinal axes LA1 or LA2 of longitudinal shells 101, 102, and a flued portion 113 extending axially and parallel to axes LA1 or LA2. The flanged portion 112 is fixedly attached such as via welding to the flued portion 113, or may be formed integrally with the flued portion as an integral unitary structural part of thereof which is produced from an annular workpiece forged or bent to define both the flanged and flued portions of each half. The two flued portions 113 are rigidly connected together such as for example via welding. The expansion joints 110, 111 extend circumferentially around the shell and have an annular construction. Expansion joints 110, 111 protrude radially outward beyond the exterior surface of the shells 101 and 102 as shown.

One flanged portion 112 of a first half of expansion joint 110 is rigidly and fixedly attached such as via welding to end 105 of longitudinal shell or 102. The other flanged portion 112 of the second half of expansion joint 110 is rigidly and fixedly attached such as via welding to tubesheet 130 (see, e.g. FIGS. 3 and 4). The inboard surface or face 135 of tubesheet 130 faces inwards to the expansion joint 110. The same construction and joining method is applicable to the other expansion joint 111 arranged on longitudinal shell 101.

FIG. 3 depicts one exemplary construction of expansion joints 110, 111 in which a single flued portion 113 is provided that bridges between the two flanged portions 112. The single flued portion may be welded to each flanged portion 112 in one embodiment. FIG. 4 depicts another exemplary construction in which an intervening annular ring 118 is welded between each flued portion 113 of expansion joint 110. It bears noting that the constructions of either FIGS. 3 and 4 may be used for one or both of expansion joints 110, 111. Other constructions however are possible. The constituent portions of expansion joints 110, 111 are preferably formed of a metal suitable for the service conditions encountered. Metals usable for the expansion joints include carbon steel, stainless steel, and nickel alloys as some non-limiting examples.

As illustrated in FIG. 3, the relatively large diameter of the expansion joints 130, 131 provides the ideal location to introduce (or extract) the shell-side fluid SSF into heat exchanger 100 without the excessively high local velocities and pressure loss that are endemic to the typical locations of shell-side inlets and outlets on the shells of heat exchangers. In addition, the introduction of a hot shell-side fluid into the heat exchanger through the expansion joint is also desirable because the expansion joint is best suited to accommodate differential thermal expansion between the shell and tube bundle.

In one embodiment, the expansion joints 110, 111 associated with shell-side outlet and inlet respectively each define an outward facing and longitudinally-extending annular nozzle mounting wall 117. Wall 117 is substantially straight in the axial direction and parallel to longitudinal axes LA1 and LA2 for mounting a shell-side inlet nozzle 121 and shell-side outlet nozzle 120. Wall 117 is of course arcuately and convexly curved in the radial direction.

The expansion joints 110, 111 each further define an annular flow plenum 114 formed inside each expansion joint. Flow plenums 114 extend circumferentially around the longitudinal shells 101, 102 and are positioned radially farther outwards and beyond the exterior surface of the shells as shown. The flow plenums 114 therefore are formed by the portions of the expansion joints 110, 111 that protrude radially outwards beyond the shells 101 and 102. The flow plenum 114 in expansion joint 110 defines a shell-side outlet flow plenum and plenum 114 in expansion joint 111 defines a shell-side inlet flow plenum. The inlet and outlet shell-side nozzles 121, 120 are in fluid communication with their respective flow plenum 114.

Referring to FIGS. 1, 3, and 4, a shell-side inlet nozzle 121 is fixedly and fluidly coupled to nozzle mounting wall 117 of expansion joint 111. Similarly, a shell-side outlet nozzle 120 is fixedly and fluidly coupled to nozzle mounting wall 117 of expansion joint 111. Each nozzle 120, 121 completely penetrates its respective nozzle mounting wall 117 and is in fluid communication with its associated flow plenum 114 formed inside expansion joints 110 and 111. In one embodiment, nozzles 120 and 121 are oriented perpendicularly to longitudinal axes LA1 and LA2 to introduce or extract the shell-side fluid transversely into/from the heat exchanger 100 as shown in FIG. 1 (note directional shell-side fluid SSF flow arrows). The shell-side fluid flows from the inlet nozzle 121 into the shell-side inlet flow plenum 114 of expansion joint 111. The shell-side fluid flows from the shell-side outlet flow plenum 114 in expansion joint 110 into the outlet nozzle 120.

Figure 9:
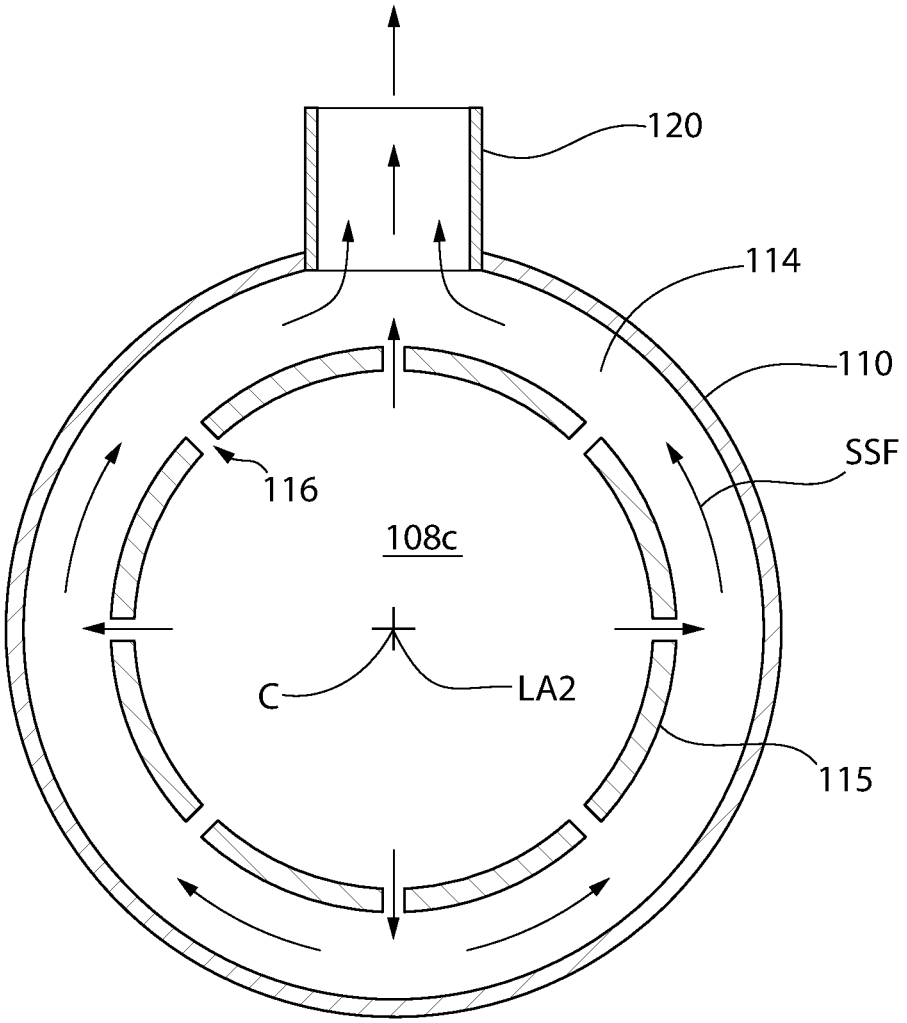
FIG. 9 is a transverse cross-sectional view taken through the expansion joints of FIG. 3 or 4.

To aid in uniformly introducing the shell-side fluid into or extracting the shell-side fluid from the shell-side spaces 108*a* and 108*c* of heat exchanger 100, perforated shell-side annular inlet and outlet flow distribution sleeves 115 are provided. FIGS. 3, 4, and 9 depict an example of the outlet flow distribution sleeve 115 recognizing that the inlet flow distribution sleeve (not separately illustrated for brevity) is identical in the present embodiment. The inlet flow distribution sleeve 115 is disposed inside expansion joint 111 and concentrically aligned with the longitudinal shell 101 and coaxial with longitudinal axis LA1. Outlet flow distribution sleeve 115 is disposed inside expansion joint 110 and concentrically aligned with longitudinal shell 102 and coaxial longitudinal axis LA2. Accordingly, the axial centerline C of each sleeve 115 coincides with its respective longitudinal axis (see, e.g. FIG. 9).

The inlet flow distribution sleeve 115 is interspersed between the shell-side inlet flow plenum 114 and shell-side space 108*a* that extends into the expansion joint 111. The outlet flow distribution shell 115 is interspersed between the shell-side outlet flow plenum 114 and shell-side space 108*c* that extends into the expansion joint 110. The inlet flow distribution sleeve 115 is in fluid communication with the shell-side inlet nozzle 121 and shell-side space 108*a* of longitudinal shell 101. Outlet flow distribution sleeve 115 is in fluid communication with the shell-side outlet nozzle 120 and shell-side space 108*c* of longitudinal shell 102. On the shell-side fluid inlet side, the flow distribution sleeve 115 forces the fluid to circulate circumferentially around the shell-side inlet flow plenum 114 before entering shell-side space 108*a* of longitudinal shell 101 (opposite to directional shell-side flow arrows SSF shown in FIG. 9). On the shell-side fluid outlet side, the flow distribution sleeve 115 forces the fluid to enter the shell-side outlet flow plenum 114 from shell-side space 108*c* of longitudinal shell 102 in a uniform circumferential flow pattern around the sleeve (as shown in FIG. 9).

Each of the inlet and outlet flow distribution sleeves 115 includes a plurality of holes or perforations 116 for introducing or extracting the shell-side fluid into or from its respective longitudinal shell 101, 102. The flow distribution sleeves 115 may have a diameter substantially coextensive with the diameter of its respective shell (see, e.g. FIG. 3 or 4). The perforations 116 may be arranged in any suitable uniform or non-uniform pattern and may have any suitable diameter. Preferably, the perforations are distributed around the entire circumference of the flow distribution sleeve 115 to promote even distribution of the shell-side fluid into or out of the respective shell-side spaces 108*a* and 108*c*. The sleeves 115 may be made of any suitable metal, such as steel, stainless steel, nickel alloy, or other. Sleeves 115 may be fixedly attached to their respective expansion joints 110 or 111 such as via welding.

Referring to FIGS. 1-9, the tube-side flow path originates with tube-side inlet nozzle 140 fluidly coupled to inlet tubesheet 130 for introducing the tube-side fluid TSF into the portion of the tube bundle 150 disposed in longitudinal shell 102 associated with the outlet of the shell-side fluid from heat exchanger 100. The tube-side fluid flows into the tubes 157 in tubesheet 130 from nozzle 140 and through the tube bundle 150 to outlet tubesheet 131 associated with longitudinal shell 101 and the inlet of the shell-side fluid into the heat exchanger 100. Tube-side outlet nozzle 141 is fluidly coupled to outlet tubesheet 131 for discharging the tube-side fluid from the heat exchanger. Nozzles 140 and 141 may be welded to their respective tubesheets 130, 131 to form a leak proof fluid connection. Nozzles 140 and 141 are each provided with free ends configured for fluid connection to external piping such as via welding, flanged and bolted joints, or other types of mechanical fluid couplings. Nozzles 140 and 141 may be made of any suitable metal such as steel and alloys thereof as some non-limiting examples. In one embodiment, nozzles 140 and 141 may be frustoconical in shape as shown if minimizing the pressure loss in the tube-side stream is important.

Figure 8:
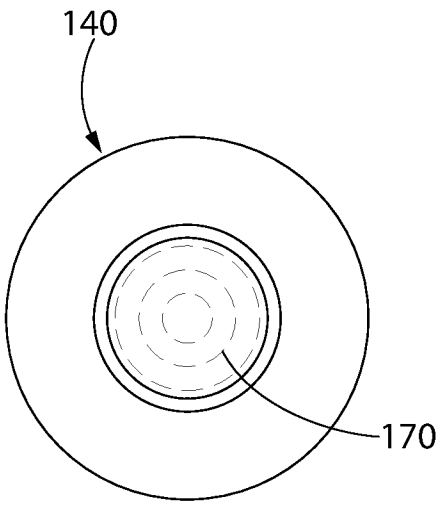
FIG. 8 is an end view thereof looking towards the inlet nozzle.
Figure 7:
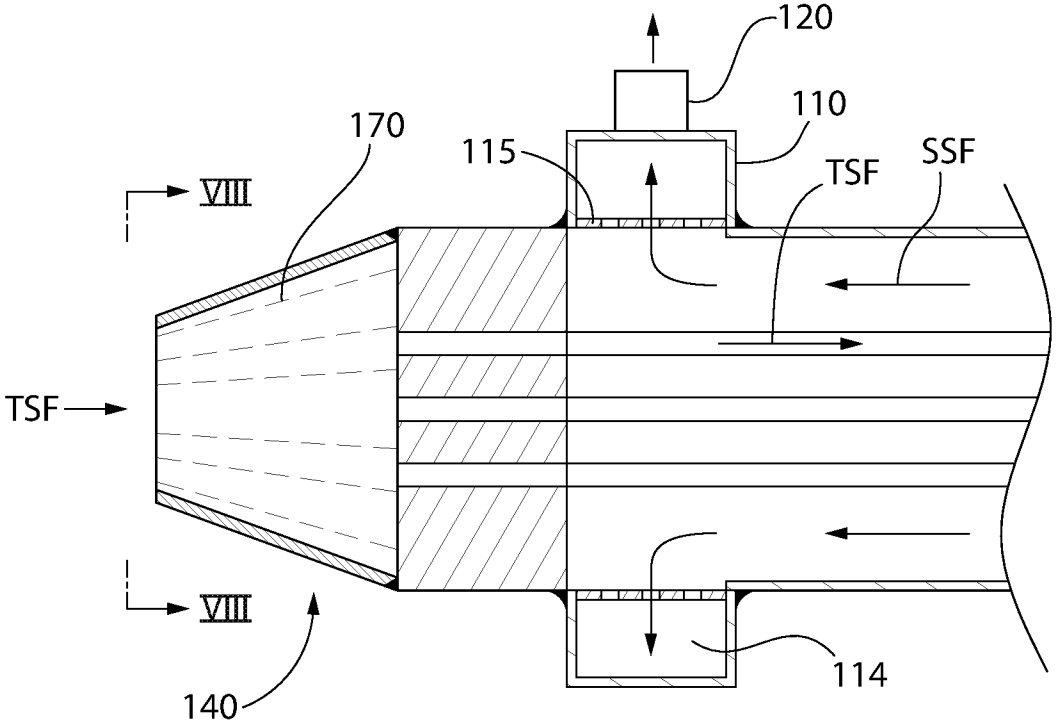
FIG. 7 is a side cross-sectional view of the tube-side inlet nozzle and associated tubesheet, expansion joint, and longitudinal shell.

In some embodiments, a plurality concentrically aligned and arranged flow straighteners 170 may optionally be provided inside nozzle 140 and/or nozzle 141 as shown in FIGS. 7 and 8 for uniform tube-side flow distribution (in the case of inlet nozzle 140) or collection (in the case of outlet nozzle 141). The flow straighteners 170 advantageously reduce turbulence in the fluid stream thereby minimizing pressure loss. Preferably, flow straighteners 170 are complementary configured to the shape of nozzles 140 and 141. In one embodiment where nozzles 140, 141 have a frustoconical shape as shown, the flow straighteners 170 each also have a similar shape but with different diameters. Flow straighteners 170 are radially spaced apart forming a plurality of annular flow passages through each nozzle between the flow straighteners. In other possible embodiments where nozzles 140, 141 may be straight walled in lieu of frustoconical shaped, the flow straighteners 170 similarly may be straight walled.

Heat exchanger 100 further includes a plurality of baffles arranged transversely inside the longitudinal shells 101, 102 and transverse shell 103 which support the tube bundle 150 and maintain spacing between the tubes. Where minimization of the shell side pressure loss is an important consideration, non-segmental baffles 180 (see, e.g. FIGS. 1 and 5) may be utilized to maintain the shell-side fluid flow in an essentially axial configuration (i.e. parallel to longitudinal axes LA1, LA2 and transverse axis TA1. Baffles 180 comprise an open latticed structure formed by a plurality diagonally intersecting straps or plates forming diamond shaped openings as shown. Dummy tubes may be utilized to block any portion of the shell-side flow from bypassing intimate contact and convective interaction with the tubes. The number and spacing of the baffles is selected to insure freedom from and minimize flow induced destructive tube vibrations which can lead to tube ruptures.

In other embodiments, the tube bundle 150 and its individual tubes 157 may be supported at suitable intervals by a combination of non-segmental and "segmented" cross baffles which are well known in the art without undue elaboration. A number of segmented baffle configurations are available, commonly known as single segmental, double segmental, triple segmental, disc and donut, etc. A mix of baffle types may be chosen to leverage most of the allowable pressure loss so as to maximize the shell side film coefficient while insuring adequate margin against the various destructive vibration modes such a fluid-elastic whirling, and turbulent buffeting. The tubes 157 facing and proximate to the shell-side outlet nozzle 120 generally require additional lateral support to protect them from the risk of flow induced tube vibration from increased localized cross flow velocities.

Where flow distribution sleeve 115 as previously described herein are used in expansion joint 110 at the shell-side outlet nozzle 120, the sleeve advantageously acts to reduce cross flow of the shell-side fluid stream to minimize flow induced tube vibration. The same safeguard against cross flow induced tube vibration applies to the shell-side fluid inlet flow distribution sleeve 115 in expansion joint 111.

Figure 6:
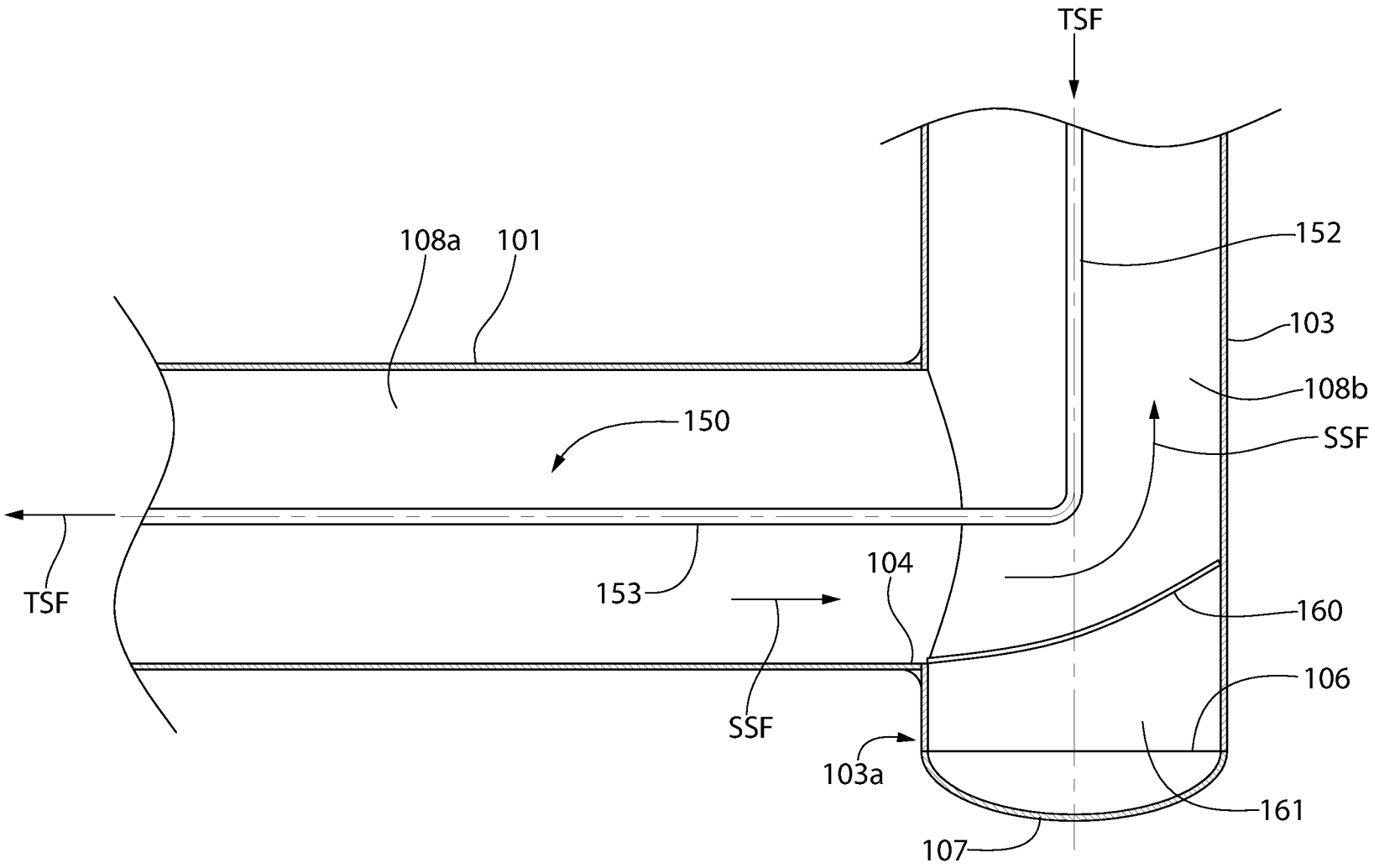
FIG. 6 is a cross-sectional view of a joint between a longitudinal and transverse shell of the heat exchanger of FIG. 1 showing a shell-side flow deflector plate.

In some embodiments, deflector plates 160 as shown in FIG. 6 may optionally be added to the region between the longitudinal shells 101, 102 and the transverse shell 103 to minimize eddies and vortices where the flow undergoes a change in direction. The flow deflector plates 160 are disposed proximate to each end 106 of transverse shell 103 at the joints connecting the longitudinal shells 101, 102 to the transverse shell. These are the locations where shell-side flow enter or leaves the transverse shell. A flow deflector plate 160 is preferably disposed inside the third shell-side space 108*b* of each end portion of the transverse shell 103 and extends transversely to the transverse shell. The flow deflector plates have one end or side positioned and welded to transverse shell 103 at the terminal end 104 of the longitudinal shells 101, 102. The remaining sides of the deflector plates 160 are welded all around to other portions of the transverse shell. Deflector plates 160 have an arcuately curved circular disk shape in some embodiments (the side or edge of plates 160 being shown in FIG. 6). The deflector plates 160 may be configured to completely seal off the cantilevered end portions of the transverse shell 103 extending laterally beyond the longitudinal shells such that the shell-side fluid is prevented from contacting the end caps 107. The deflector plates 160 therefor create fully enclosed and sealed fluid dead spaces 161 at the ends 106 of the transverse shell 103 between the end caps 107 and deflector plates. Deflector plates 160 may be made of any suitable metal compatible for welding to the shells, such as for example without limitation steel and alloys thereof.

Heat exchanger 100 may be arranged to produce counterflow between the shell-side and tube-side fluids SSF, TSF as shown in FIG. 1 to maximize heat transfer efficiency. The tube-side fluid enters and leaves the heat exchanger in an axial direction parallel to and coinciding with longitudinal axes LA2 and LA1, respectively. The shell-side fluid enters and leave the heat exchanger in a radial direction perpendicularly to longitudinal axes LA1 and LA2, respectively. In other possible embodiments, co-flow may be used in which the shell-side and tube-side fluids flow in the same direction.

Figure 10:
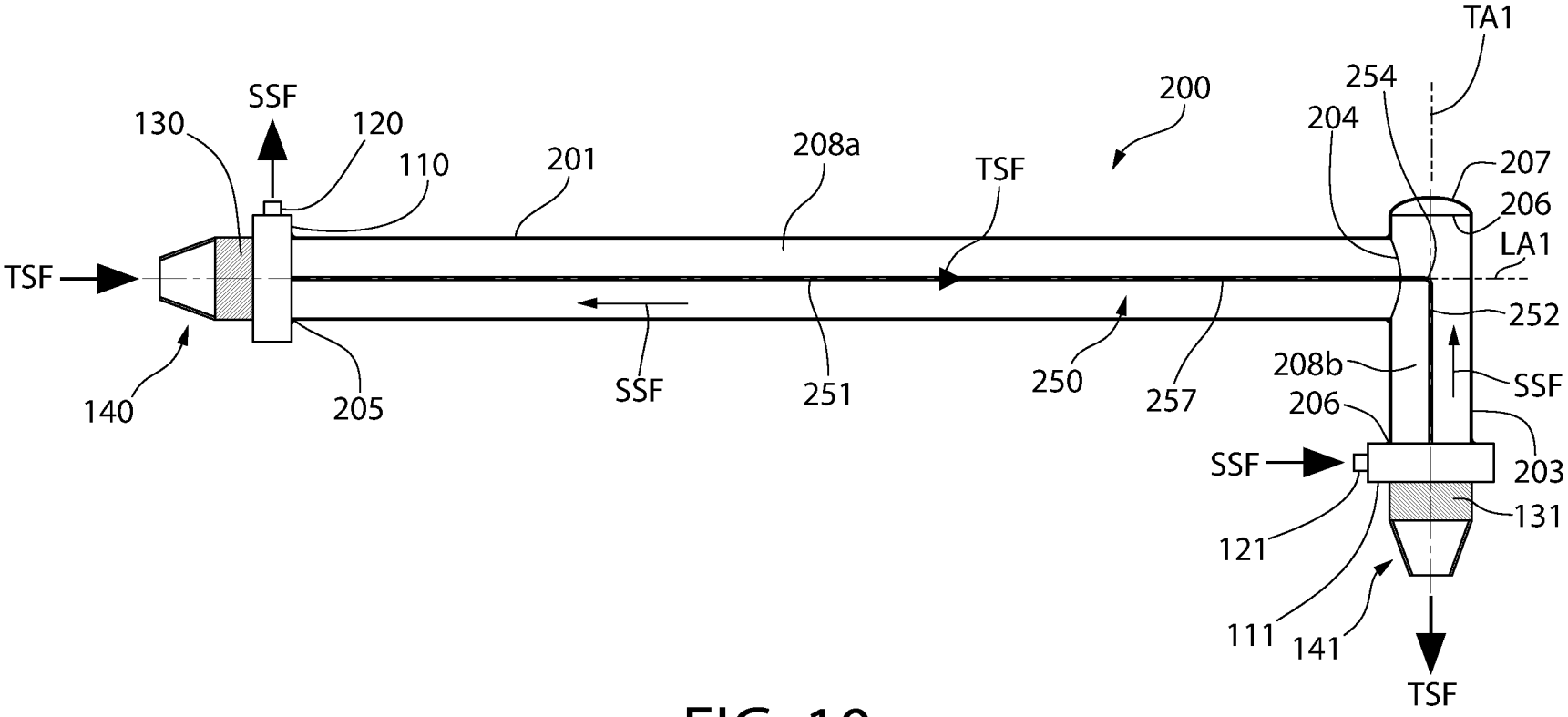
FIG. 10 is a plan view of a second embodiment of a heat exchanger according to the present disclosure.

FIG. 10 depicts an alternative embodiment of a heat exchanger 200 constructed in accordance with same principles and features already described herein for heat exchanger 100. Heat exchanger 200, however, has an L-shaped arrangement of shells 201, 203 and tube bundle 250. Other features are the same as heat exchanger 100. Generally, heat exchanger 200 includes a single longitudinal shell 201 defining an internal shell-side space 208*a* and transverse shell 203 defining a shell-side space 208*b* in fluid communication with shell-side space 208*a*. Transverse shell 203 is oriented perpendicularly to and fluidly coupled to terminal end 204 of shell 201. The other end of shell 201 is fluidly coupled to expansion joint 110 which includes the shell-side outlet nozzle 120. Expansion joint 110 is fluidly coupled to tube-side inlet tubesheet 130 which is fluidly coupled to tube-side inlet nozzle 140. Expansion joint 111 is fluidly coupled between one terminal end 206 of transverse shell 203 and tube-side outlet tubesheet 131 which is connected to tube-side outlet nozzle 141. End cap 207 is attached to the remaining end 206 of transverse shell 203 which is formed on a cantilevered end portion of shell 203 that extends laterally beyond longitudinal shell 2201 as shown.

Longitudinal shells 201 may each be longer than transverse shell 203, which in some embodiments has a length greater than the diameter of the longitudinal shell, and in some cases a length greater than twice the diameter of the longitudinal shell. In some embodiments, longitudinal shell 201 has a length greater than twice the length of the transverse shell 203.

Tube bundle 250 is L-shaped comprising a plurality of tubes 257 of the same configuration. Tubes 257 comprise a straight tube leg 251 in shell 201 and a straight tube leg 252 in shell 203. The straight tube legs 251 and 252 are fluidly coupled together by a radiused tube bend 254 to form a continuous tube-side flow path for the tube-side fluid between the tubesheets.

The expansion joints 110 and 111 may be the same as previously described herein with respect to heat exchanger 100 including flow distribution sleeves 115 and flow plenums 114. Tube-side inlet and outlet nozzles 140, 141 may be the same and can include concentric flow straighteners 170. A single deflector plate 160 may be disposed in transverse shell 203 at the same position described for transverse shell 103 near end cap 207 at the junction with longitudinal shell 201. Heat exchanger 200 provides the same benefits as heat exchanger 100 including the ability to accommodate differential thermal expansion between the tube bundle and shells. Heat exchanger 200 may be arranged to produce countercurrent flow between the shell-side and tube-side fluids as shown in FIG. 10 to maximize heat transfer efficiency. In other embodiments, the flow may be co-flow.

Additional advantages of the heat exchangers 100 and 200 disclosed herein include: a compact space requirement; maximum flexibility with respect to installation and orientation; reduced risk of severe stresses from restraint of thermal expansion; ability to withstand thermal and pressure transients is enhanced; and the shell-side pressure loss in the flow stream is minimized for optimal heat transfer performance by use of non-segmental baffles.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A heat exchanger comprising:

a longitudinally-extending first shell defining a first shell-side space and a first longitudinal axis;

a longitudinally-extending second shell defining a second shell-side space and a second longitudinal axis, the second shell arranged parallel to the first shell;

a transverse third shell fluidly coupling the first and second shells together, the third shell extending laterally between the first and second shells and defining a third shell-side space in fluid communication with the first and second shell-side spaces, and a transverse axis elongated in a direction perpendicular to the first and second axes;

a tube bundle comprising a plurality of tubes each defining a tube-side space, the tube bundle extending through the first, second, and third shells;

a shell-side inlet nozzle fluidly coupled to the first shell; and a shell-side outlet nozzle fluidly coupled to the second shell;

wherein a shell-side fluid flows in path from the first shell-side space through the third shell-side space to the second shell-side space;

the third shell including a first end portion extending laterally outwards beyond the first shell forming a first cantilevered end, and a first end cap attached to the first cantilevered end and oriented parallel to the first longitudinal axis;

the third shell including a second end portion extending laterally outwards beyond the second shell forming a second cantilevered end, and a second end cap attached to the second cantilevered end and oriented parallel to the second longitudinal axis;

a first flow deflector plate disposed inside the third shell-side space of the first end portion and extending transversely to the third shell, the first flow deflector plate having one end connected to a first terminal end of the first shell and another end connected to the third shell, the first flow deflector plate being configured to prevent the shell-side flow from contacting the first end cap;

a second flow deflector plate disposed inside the third shell-side space of the second end portion and extending transversely to the third shell, the second flow deflector plate having one end connected to a first terminal end of the second shell and another end connected to the third shell, the second flow deflector plate being configured to prevent the shell-side flow from contacting the second end cap;

the first and second flow deflector plates creating fully enclosed and sealed fluid dead spaces at the first and second cantilevered ends of the third shell between the first and second end caps and the first and second deflector plates, respectively.

2. The heat exchanger according to claim 1, wherein the third shell is orientated perpendicularly to the first and second shells.

3. The heat exchanger according to claim 2, wherein the third shell is fluidly coupled to a first terminal end of each of the first and second shells.

4. The heat exchanger according to claim 3, further comprising a first tubesheet coupled to a second terminal end of the first shell and a second tubesheet coupled to a second terminal end of the second shell.

5. The heat exchanger according to claim 4, further comprising a first expansion joint coupled between the first tubesheet and the first terminal end of first shell.

6. The heat exchanger according to claim 5, wherein the first expansion joint is a flanged and flued expansion joint comprising a first half and a second half, the first and second halves collectively defining a pair of axially spaced first and second flanged portions each extending perpendicularly to the first longitudinal axis, and a pair of first and second flued portions each extending parallel to the first longitudinal axis, the first and second flued portions being welded together.

7. The heat exchanger according to claim 6, wherein the shell-side inlet nozzle is fluidly coupled to the first expansion joint, and wherein the shell-side fluid is introduced into the first shell through the first expansion joint in a radial direction.

8. The heat exchanger according to claim 7, wherein the first expansion joint defines an annular nozzle mounting wall, the shell-side inlet nozzle being fluidly and perpendicularly coupled to the nozzle mounting wall of the first expansion joint.

9. The heat exchanger according to claim 7, further comprising a shell-side annular inlet flow distribution sleeve disposed inside the first expansion joint, the inlet flow distribution sleeve in fluid communication with the shell-side inlet nozzle and comprising a plurality of perforations for introducing the shell-side fluid into the first shell-side space of the first shell.

10. The heat exchanger according to claim 9, further comprising an annular outlet flow plenum formed inside the first expansion joint between the shell-side inlet nozzle and the flow distribution sleeve, wherein the shell-side fluid flows from the shell-side inlet nozzle into and circumferentially around the annular outlet flow plenum and through the perforations in the flow distribution sleeve into the first shell-side space of the first shell.

11. The heat exchanger according to claim 10, wherein the annular outlet flow plenum inside the first expansion joint is arranged circumferentially around the first shell in a radial position farther outwards than an exterior surface of the first shell.

12. The heat exchanger according to claim 5, further comprising:

a second expansion joint coupled between the second tubesheet and the second terminal end of second shell;

an annular outlet flow distribution plenum formed inside the second expansion joint;

a shell-side outlet flow distribution sleeve disposed inside the second expansion joint and comprising a plurality of perforations; and the shell-side outlet nozzle fluidly coupled to the second expansion joint, wherein the shell-side fluid is evacuated from the second shell-side space of the second shell through in order the outlet flow distribution sleeve, the annular outlet flow distribution plenum, and the shell-side outlet nozzle.

13. The heat exchanger according to claim 4, further comprising a tube-side inlet nozzle fluidly coupled to the first tubesheet for introducing a tube-side fluid into the first shell in an axial direction and a tube-side outlet nozzle fluidly coupled to the second tubesheet for extracting the tube-side fluid from the second shell in an axial direction.

14. The heat exchanger according to claim 13, wherein the shell-side fluid flows in a direction counter to the tube-side fluid through the heat exchanger.

15. The heat exchanger according to claim 14, wherein the tube-side inlet and outlet nozzles each have a frustoconical shape and are oriented coaxially with first and second longitudinal axes, respectively.

16. The heat exchanger according to claim 13, wherein at least one of the tube-side inlet nozzle and tube-side outlet nozzle comprises a plurality of concentrically aligned internal flow straighteners.

17. The heat exchanger according to claim 1, wherein the tubes of the tube bundle each have a squared U-shape comprising a first straight section disposed in the first shell, a second straight section disposed in the second shell and oriented parallel to the first straight section, and a third straight section disposed in the third shell and oriented perpendicularly to the first and second straight sections, the first straight section fluidly coupled to the third straight section via a 90 degree radiused bend section, and the second straight sections fluidly coupled to the third straight section via a 90 degree radiused bend section.

18. The heat exchanger according to claim 4, wherein the first and second tubesheets are disposed laterally adjacent and parallel to each other.

* * * * *